US008876624B2

(12) United States Patent
Ban et al.

(10) Patent No.: US 8,876,624 B2
(45) Date of Patent: Nov. 4, 2014

(54) GOLF CLUB HEAD

(75) Inventors: Wataru Ban, Chichibu (JP); Kozue Wada, Minato-ku (JP)

(73) Assignee: Bridgestone Sports Co., Ltd., Tokyo (JP)

( * ) Notice: Subject to any disclaimer, the term of this patent is extended or adjusted under 35 U.S.C. 154(b) by 58 days.

(21) Appl. No.: 13/599,347

(22) Filed: Aug. 30, 2012

(65) Prior Publication Data

US 2013/0109497 A1 May 2, 2013

(30) Foreign Application Priority Data

Oct. 27, 2011 (JP) ..... 2011-236440

(51) Int. Cl.
*A63B 53/00* (2006.01)
*A63B 53/06* (2006.01)

(52) U.S. Cl.
CPC ..... *A63B 53/06* (2013.01)
USPC ..... 473/288; 473/334; 473/350

(58) Field of Classification Search
CPC ..... A63B 53/06; A63B 2053/0416; A63B 2053/0433; A63B 2209/00
USPC ..... 473/288, 324, 350, 334
See application file for complete search history.

(56) References Cited

U.S. PATENT DOCUMENTS 2,332,342 A * 10/1943 Reach ..... 473/248
4,121,832 A * 10/1978 Ebbing ..... 473/335
5,346,213 A * 9/1994 Yamada ..... 473/329
5,776,010 A 7/1998 Helmstetter et al.
6,659,883 B2 12/2003 Nelson et al.
7,048,646 B2 5/2006 Yamanaka et al.
7,244,188 B2 7/2007 Best
7,354,356 B2 4/2008 Yamanaka
7,601,076 B2 * 10/2009 Rollinson ..... 473/288
7,604,550 B1 * 10/2009 Currie ..... 473/342
8,025,586 B2 * 9/2011 Teramoto ..... 473/221
8,033,931 B2 * 10/2011 Wahl et al. ..... 473/342
8,382,604 B2 * 2/2013 Billings ..... 473/244
8,409,028 B2 * 4/2013 Wahl et al. ..... 473/288
8,491,405 B2 * 7/2013 Jorgensen et al. ..... 473/288
8,556,745 B2 * 10/2013 Currie ..... 473/342
2002/0098911 A1 7/2002 Nelson et al.
2003/0022730 A1 1/2003 Nelson et al.
2003/0119601 A1 6/2003 Nelson et al.
2005/0255938 A1 11/2005 Soracco
2006/0052183 A1 3/2006 Soracco et al.
2006/0052184 A1 3/2006 Soracco et al.
2006/0172822 A1 8/2006 Liang et al.

(Continued)

FOREIGN PATENT DOCUMENTS

JP 5-015972 U 3/1993
JP 6-269521 A 9/1994

(Continued)

*Primary Examiner* — William Pierce
(74) *Attorney, Agent, or Firm* — Sughrue Mion, PLLC

(57) ABSTRACT

This invention provides a golf club head including a face surface and sole portion. This golf club head includes a main body member, a face member, a sole member, and a fastening structure which fastens the main body member, the face member, and the sole member to be separable from each other. The main body member, the face member, and the sole member include stack portions, respectively, which are stacked on each other. The fastening structure fastens the main body member, the face member, and the sole member together in the stack portions.

9 Claims, 6 Drawing Sheets

(56) References Cited

U.S. PATENT DOCUMENTS

| | | | | |
|---|---|---|---|---|
| 2008/0015051 | A1 | 1/2008 | Roach et al. | |
| 2008/0051220 | A1 | 2/2008 | Soracco et al. | |
| 2009/0149274 | A1* | 6/2009 | Rollinson | 473/340 |
| 2009/0221382 | A1 | 9/2009 | Soracco et al. | |
| 2010/0056297 | A1 | 3/2010 | Roach et al. | |
| 2010/0160062 | A1* | 6/2010 | Teramoto | 473/251 |
| 2010/0167836 | A1 | 7/2010 | Horii et al. | |
| 2010/0167838 | A1 | 7/2010 | Horii | |
| 2010/0331104 | A1* | 12/2010 | Renna | 473/340 |
| 2011/0014994 | A1 | 1/2011 | Chuang | |
| 2013/0109497 | A1* | 5/2013 | Ban et al. | 473/330 |

FOREIGN PATENT DOCUMENTS

| | | | |
|---|---|---|---|
| JP | 6-296713 | A | 10/1994 |
| JP | 9-276453 | A | 10/1997 |
| JP | 10-211304 | A | 8/1998 |
| JP | 2002-224254 | A | 8/2002 |
| JP | 2005-066249 | A | 3/2005 |
| JP | 2006-231064 | A | 9/2006 |
| JP | 2006-239154 | A | 9/2006 |
| JP | 2010-148652 | A | 7/2010 |
| JP | 2010-148653 | A | 7/2010 |

* cited by examiner

GOLF CLUB HEAD

BACKGROUND OF THE INVENTION

1. Field of the Invention

The present invention relates to a golf club head.

2. Description of the Related Art

A golf club head manufactured by assembling a plurality of members has been proposed. Japanese Patent Laid-Open No. 6-296713, for example, discloses an iron club set including a head body and a face member as separate members. A golf club head including constituent parts which can be selected by the user has also been proposed. Japanese Patent Laid-Open No. 6-269521, for example, discloses a golf club head including a face member attached to the head body which can be replaced.

Japanese Utility Model Laid-Open No. 5-15972 discloses a golf club head manufactured by assembling a head body member, a face member, a frame member, and a sole member. The golf club head described in Japanese Utility Model Laid-Open No. 5-15972 includes these members detachably fixed in place by connecting members such as screws. In this literature, FIG. 2 illustrates an arrangement in which a face member is fixed to a frame member via a screw, and another arrangement in which a sole member is fixed to a head body member via a screw. Note that this literature does not give details of structures for fixing the head body member and frame member.

When a golf club head is implemented using a larger number of parts, the number of choices of parts that can be replaced by the user in accordance with his or her tastes increases. However, this makes it cumbersome to disassemble and assemble the golf club head.

SUMMARY OF THE INVENTION

It is an object of the present invention to provide a golf club head which includes parts that can be replaced by the user in accordance with his or her tastes, and which is easy to disassemble and assemble.

According to the present invention, there is provided a golf club head including a face surface and a sole portion, comprising: a main body member; a face member which at least partially forms the face surface; a sole member which at least partially forms the sole portion; and a fastening structure which fastens the main body member, the face member, and the sole member to be separable from each other, the main body member, the face member, and the sole member including stack portions, respectively, which are stacked on each other, wherein the fastening structure fastens the main body member, the face member, and the sole member together in the stack portions.

Further features of the present invention will become apparent from the following description of exemplary embodiments, with reference to the attached drawings.

DESCRIPTION OF THE EMBODIMENTS

<First Embodiment>

Figure 1A:
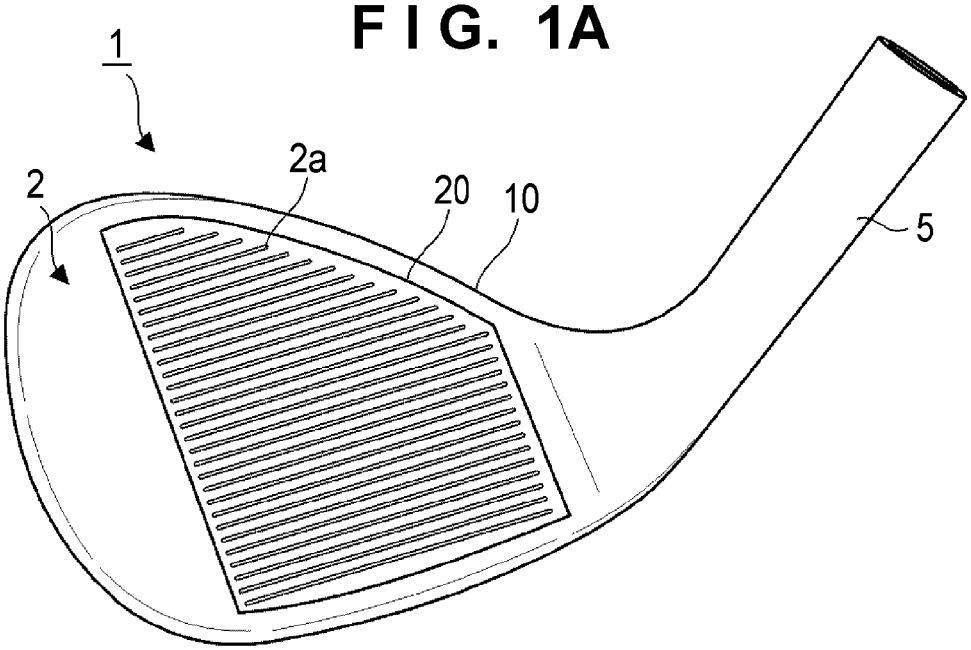
FIGS. 1A and 1B are perspective views of a golf club head according to the first embodiment of the present invention.
Figure 1B:
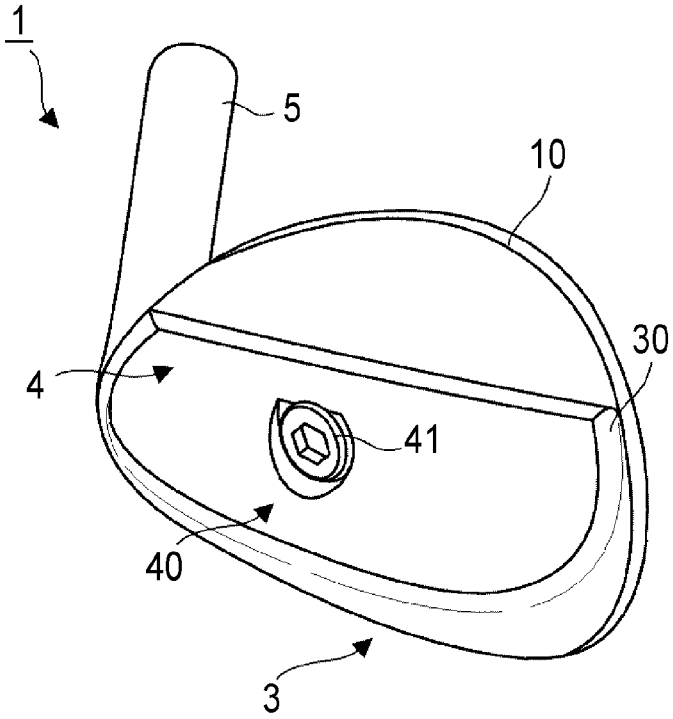

FIGS. 1A and 1B are perspective views of a golf club head 1 according to the first embodiment of the present invention, in which FIG. 1A is a perspective view when viewed from the side of the face surface; and FIG. 1B is a perspective view when viewed from the back side. FIGS. 1A and 1B illustrate an example in which the present invention is applied to an iron type golf club head and, more particularly, to a wedge type golf club head. The present invention is suitable for general iron type golf club heads and, more particularly, for a golf club head having a loft angle of 30° (inclusive) to 70° (inclusive) and a weight of 240 g (inclusive) to 320 g (inclusive). However, the present invention is also applicable to wood and utility (hybrid) type golf club heads.

The golf club head 1 includes a face surface (striking surface) 2, sole portion 3, back portion 4, and hosel portion 5. A shaft (not shown) is attached to the hosel portion 5. A plurality of scorelines 2*a* are formed in the face surface 2. The scorelines 2*a* are parallel linear grooves running in the toe-to-heel direction.

Figure 2:
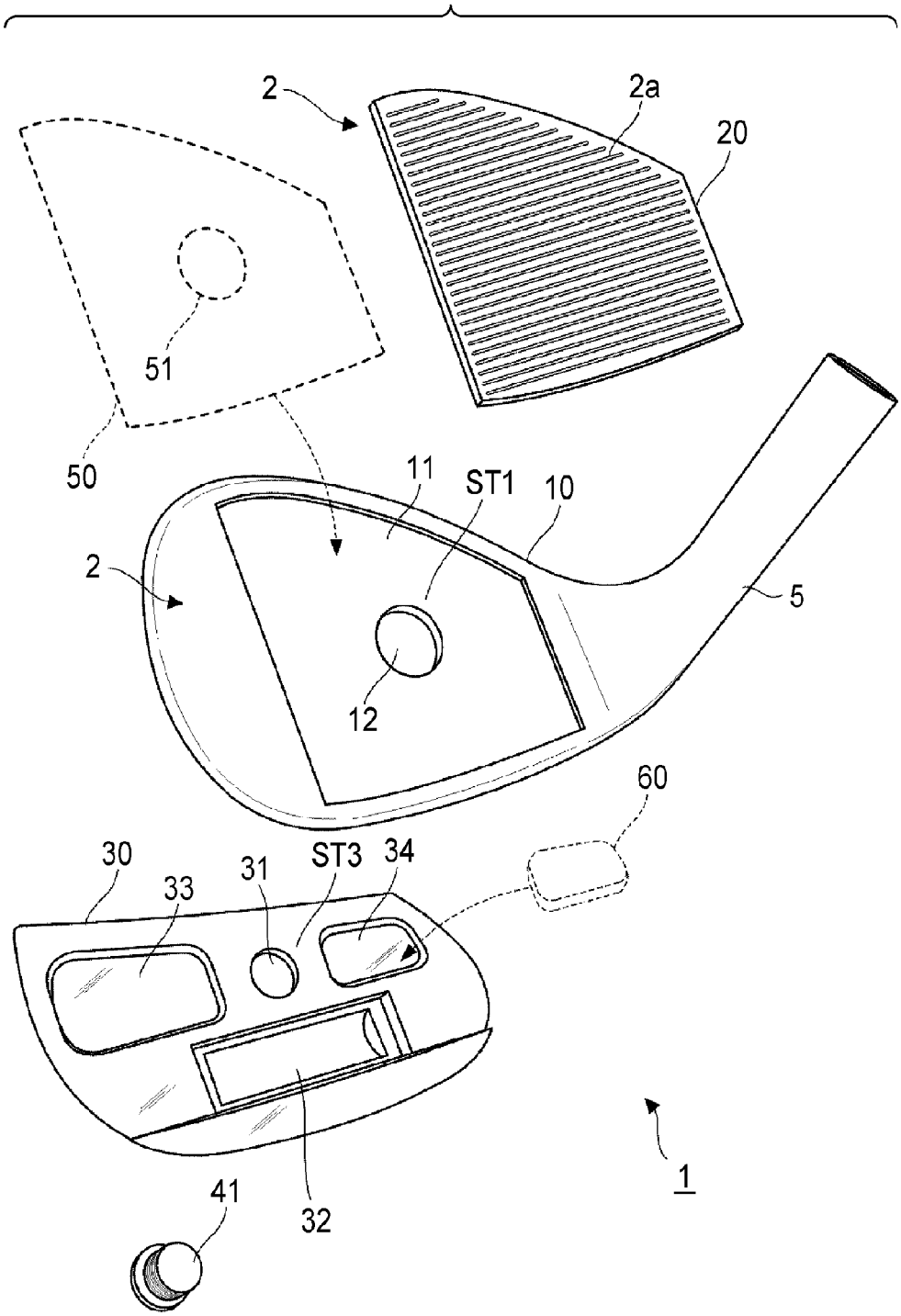
FIG. 2 is an exploded perspective view of the golf club head according to the first embodiment.
Figure 3:
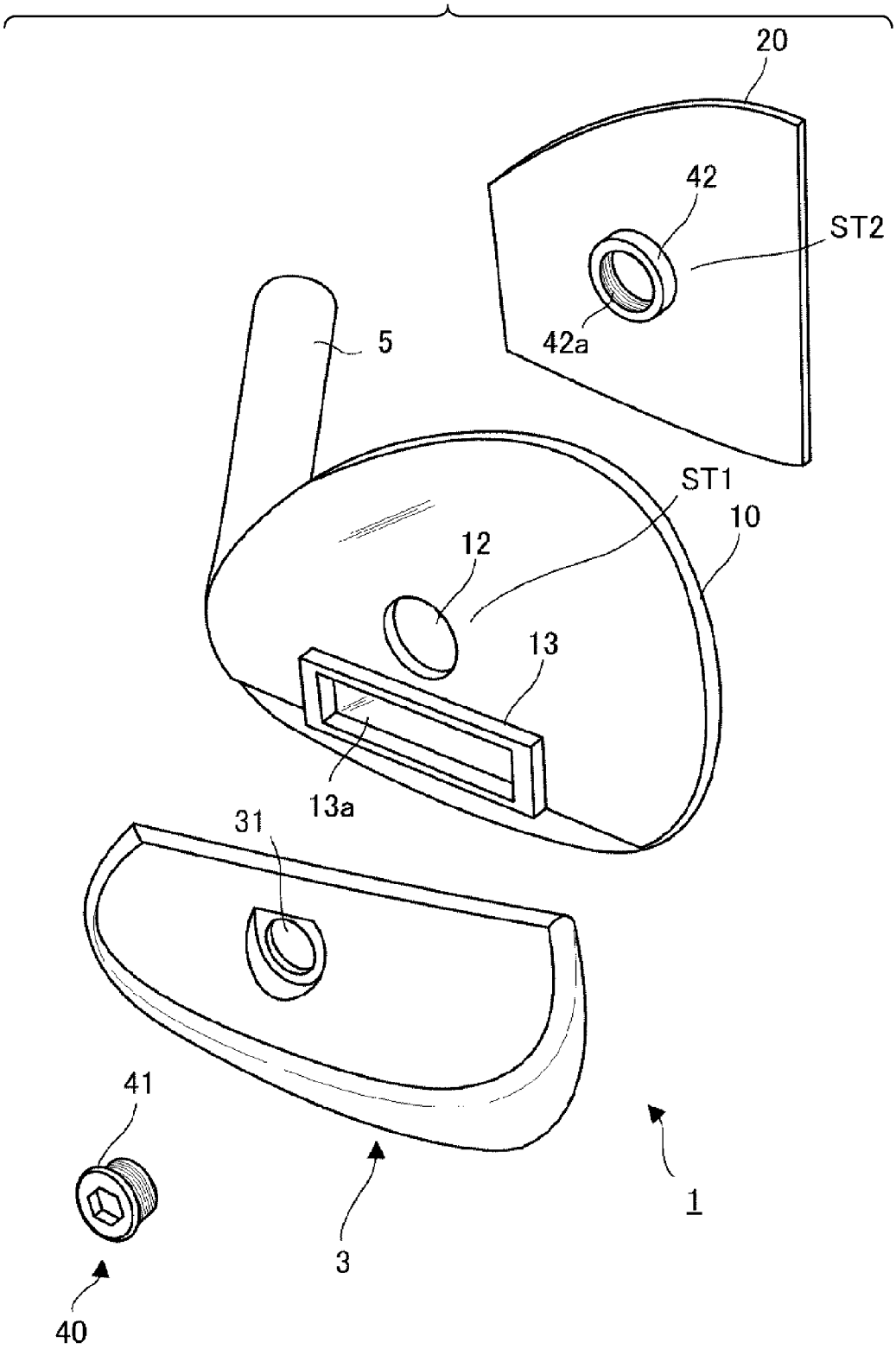
FIG. 3 is an exploded perspective view of the golf club head according to the first embodiment.

The golf club head 1 has an outer shape formed by the following three parts as its basic arrangement. That is, the golf club head 1 includes a main body member 10, face member 20, and sole member 30, which are fastened by a fastening structure 40 to be separable from each other. FIGS. 2 and 3 are exploded perspective views of the golf club head 1, in which FIG. 2 is an exploded perspective view when viewed from the side of the face surface; and FIG. 3 is an exploded perspective view when viewed from the back side.

The main body member 10 includes the hosel portion 5. The main body member 10 includes a recessed portion 11 which is formed on the side of the face surface 2 and in which the face member 20 is mounted. A hole 12 is formed in the recessed portion 11 to extend through the main body member 10 in the face-to-back direction. A rectangular cylinder-shaped projecting portion 13 is formed on the main body member 10 on the side of the back portion 4. The projecting portion 13 defines a recessed portion 13*a* formed in it.

A buffer member 50 may be selectively interposed between the face member 20 and the recessed portion 11 in the main body member 10. Providing the buffer member 50 makes it possible to maintain the state in which the members 10, 20, and 30 are fastened by the fastening structure 40, and to improve an impact feel. The buffer member 50 is preferably a viscoelastic body. An example of the viscoelastic body is NBR (acrylonitrile butadiene rubber). Instead of this, the buffer member 50 may be, for example, nonwoven fabric or cloth. In this embodiment, the buffer member 50 has a sheet shape and includes a hole 51, formed at a position corresponding to the hole 12 in the main body member 10.

Although an arrangement in which the buffer member 50 is interposed between the main body member 10 and the face member 20 has been exemplified in this embodiment, the position of a buffer member is not limited to this, and a buffer member may be interposed between the main body member 10 and the sole member 30. This means that a buffer member can be interposed between adjacent members. Also, buffer members can be interposed between all pairs of adjacent members. More specifically, buffer members may be interposed both between the main body member 10 and the face member 20, and between the main body member 10 and the sole member 30.

The face member 20 serves to at least partially form the face surface 2. In this embodiment, the face member 20 forms the entire region of the face surface 2, in which the scorelines 2*a* are formed.

The sole member 30 serves to at least partially form the sole portion 3. In this embodiment, the sole member 30 forms almost the entire region of the sole portion 3, except for the edge portion on the side of the face surface 2. The main body member 10 forms the edge portion on the side of the face surface 2.

A hole 31 is formed in the sole member 30 to extend through it in the face-to-back direction. Also, recessed portions 32 to 34 are formed in portions of the sole member 30 on the side of the face surface 2. The recessed portion 32 has a contour with the same shape as that of the contour of the projecting portion 13 on the main body member 10, and the main body member 10 and sole member 30 are positioned by inserting the projecting portion 13 into the recessed portion 32. In other words, the projecting portion 13 and recessed portion 32 form a portion which positions the main body member 10 and sole member 30.

The recessed portion 13*a* in the projecting portion 13, and the recessed portion 32 form a closed space. Also, the recessed portions 33 and 34 respectively form closed spaces with the back surface of the main body member 10. A weight distribution adjusting member 60 can be selectively accommodated in each of these spaces. The weight distribution of the golf club head 1 can be changed by accommodating the weight distribution adjusting member 60 in each of these spaces. A weight member obtained by mixing, for example, a metal powder in rubber can be used as the weight distribution adjusting member 60. Also, the weight distribution adjusting member 60 may be a compact member such as an elastic body or resin foam. Moreover, each of these spaces may be provided with a member (for example, a buffer member) which is not intended to adjust the weight distribution of the golf club head 1.

The fastening structure 40 includes a bolt 41 and a screw hole 42*a* formed in the back surface of the face member 20. The screw hole 42*a* is formed by forming threads in the inner circumferential surface of a cylindrical boss portion 42 formed on the back surface of the face member 20.

In this embodiment, the main body member 10, face member 20, and sole member 30 include stack portions ST1, ST2, and ST3, respectively, stacked on each other in the face-to-back direction. The hole 12, screw hole 42*a*, and hole 31 are formed in the stack portions ST1, ST2, and ST3, respectively. The face member 20, main body member 10, and sole member 30 are stacked on each other in the face-to-back direction to align the screw hole 42*a* and holes 12 and 31. At this time, the stack portion ST1 is positioned between the stack portions ST2 and ST3. In this embodiment, the boss portion 42 is inserted into the hole 12 so as to easily align the main body member 10 and face member 20. The bolt 41 is inserted into the holes 31 and 12 so as to threadably engage with the screw hole 42*a*, thereby fastening it. Upon this operation, the main body member 10, face member 20, and sole member 30 are fastened together and fixed to each other in the stack portions ST1 to ST3.

Since the main body member 10, face member 20, and sole member 30 are fastened together and fixed to each other, they can be simultaneously disassembled and fixed to each other simply by inserting/removing the bolt 41. This makes it easy to disassemble and assemble the golf club head 1.

Preparing pluralities of types of face members 20 and sole members 30 allows the user to replace the parts in accordance with his or her tastes. Preparing a plurality of types of face members 20 allows the user to adjust the impact feel and the spin amount in accordance with his or her tastes. Also, preparing a plurality of types of sole members 30 allows the user to adjust the playability and the barycentric position in accordance with his or her tastes.

Examples of the face members 20 to be prepared include those made of different materials, those having scorelines 2*a* with different specifications, and those having face surfaces 2 with different surface roughnesses. Examples of the face members 20 made of different materials include those with different hardnesses.

The impact feel can be improved by preparing a face member 20 made of a material softer than that of the main body member 10. For example, soft iron or stainless steel is used as the material of the main body member 10, and pure titanium, copper, an aluminum alloy, brass, or soft iron is used as the material of the face member 20.

Examples of the sole members 30 to be prepared include those with different bounce angles, those with different widths, and those made of different materials. Examples of the sole members 30 made of different materials include those with different hardnesses or specific gravities. The abrasion resistance of the golf club head 1 can be improved by preparing a sole member 30 made of a material harder than that of the main body member 10. For example, soft iron or stainless steel is used as the material of the main body member 10, and stainless steel, maraging steel, a tungsten alloy, a titanium alloy, or beryllium copper is used as the material of the sole member 30.

Preparing a sole member 30 made of a material having a specific gravity different by 1 or more from that of the material of the main body member 10 allows the user to easily perceive a difference in barycentric position. When a material having a relatively high specific gravity is used as that of the sole member 30, the golf club head 1 has a relatively low center of gravity. However, when a material having a relatively low specific gravity is used as that of the sole member 30, the golf club head 1 has a relatively high center of gravity.

Note that the fastening structure 40 is not limited to the above-mentioned example, and can adopt various arrangements. For example, although the boss portion 42 is formed in the face member 20 in this embodiment, an arrangement including, in place of the bolt 41, a screw shaft fixed to the face member 20, and a nut which threads into the screw shaft from the side of the back portion 4 may be adopted. Alternatively, an arrangement including through holes formed in the main body member 10, the face member 20, and the sole member 30, bolts inserted into these through holes, and nuts which threads into these bolts may be adopted.

Also, although an arrangement in which the stack portions ST1, ST2, and ST3 are stacked on each other in the face-to-back direction is adopted in this embodiment, one in which the stack portions ST1, ST2, and ST3 are stacked on each other in the sole-to-top direction may be adopted. Moreover, the order of stacking of the stack portions ST1, ST2, and ST3 is not limited to the order of the stack portion of the face member 20, that of the main body member 10, and that of the sole member 30.

<Second Embodiment>

Although one fastening structure 40 is provided in the above-mentioned first embodiment, a plurality of fastening structures may be provided. A fixing force which acts between parts can be improved by providing a plurality of fastening structures. However, as the number of fastening structures increases, it becomes more troublesome to disassemble and assemble the golf club head. Accordingly, two to four fastening structures are preferably used. Also, various methods of dividing parts: the main body member, face member, and sole member can be adopted. An example in which a plurality of (two) fastening structures are provided to change a method of dividing the main body member, face member, and sole member will be described below.

Figure 4A:
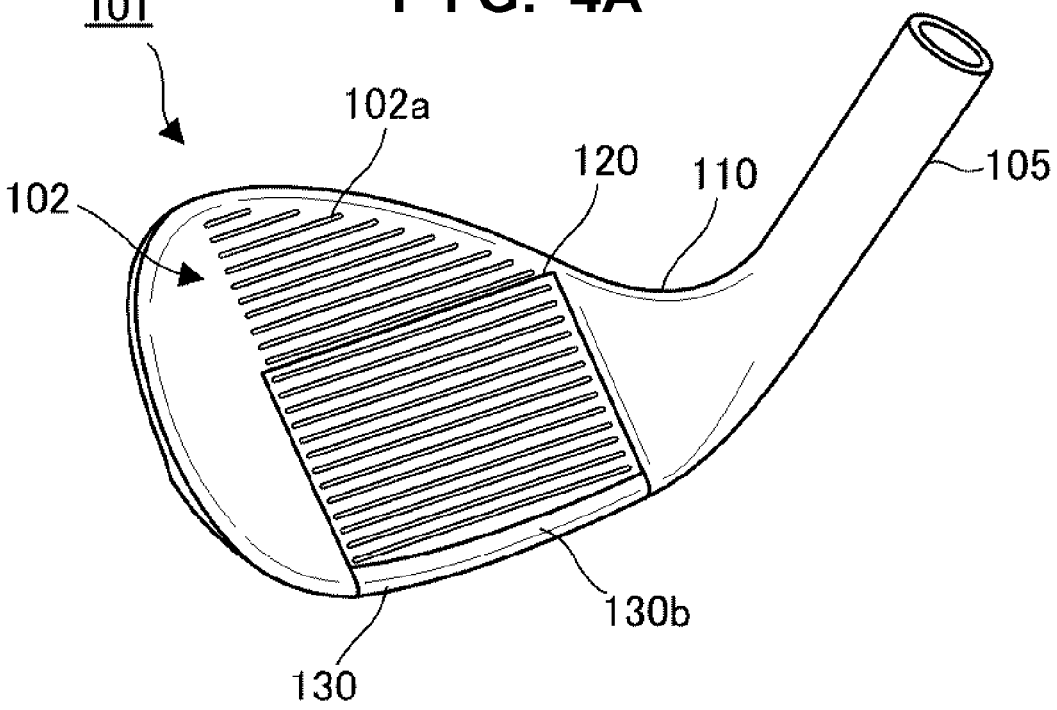
FIGS. 4A and 4B are perspective views of a golf club head according to the second embodiment of the present invention.
Figure 4B:
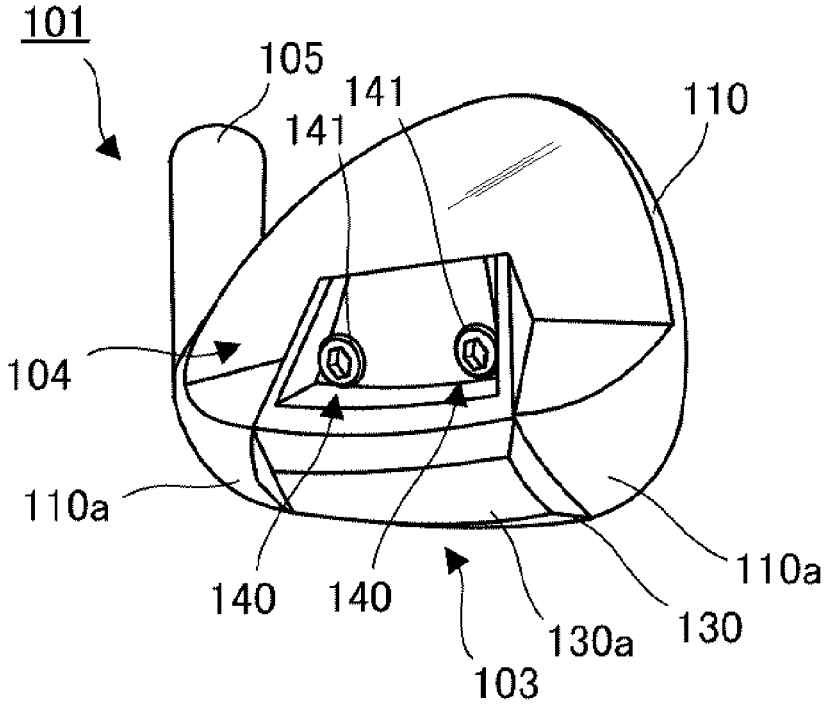

FIGS. 4A and 4B are perspective views of a golf club head 101 according to the second embodiment of the present invention, in which FIG. 4A is a perspective view when viewed from the side of the face surface; and FIG. 4B is a perspective view when viewed from the back side. This embodiment also provides an example in which the present invention is applied to an iron type golf club head and, more particularly, to a wedge type golf club head.

The golf club head 101 includes a face surface (striking surface) 102, sole portion 103, back portion 104, and hosel portion 105. A shaft (not shown) is attached to the hosel portion 105. A plurality of scorelines 102*a* are formed in the face surface 102. The scorelines 102*a* are parallel linear grooves running in the toe-to-heel direction.

Figure 5:
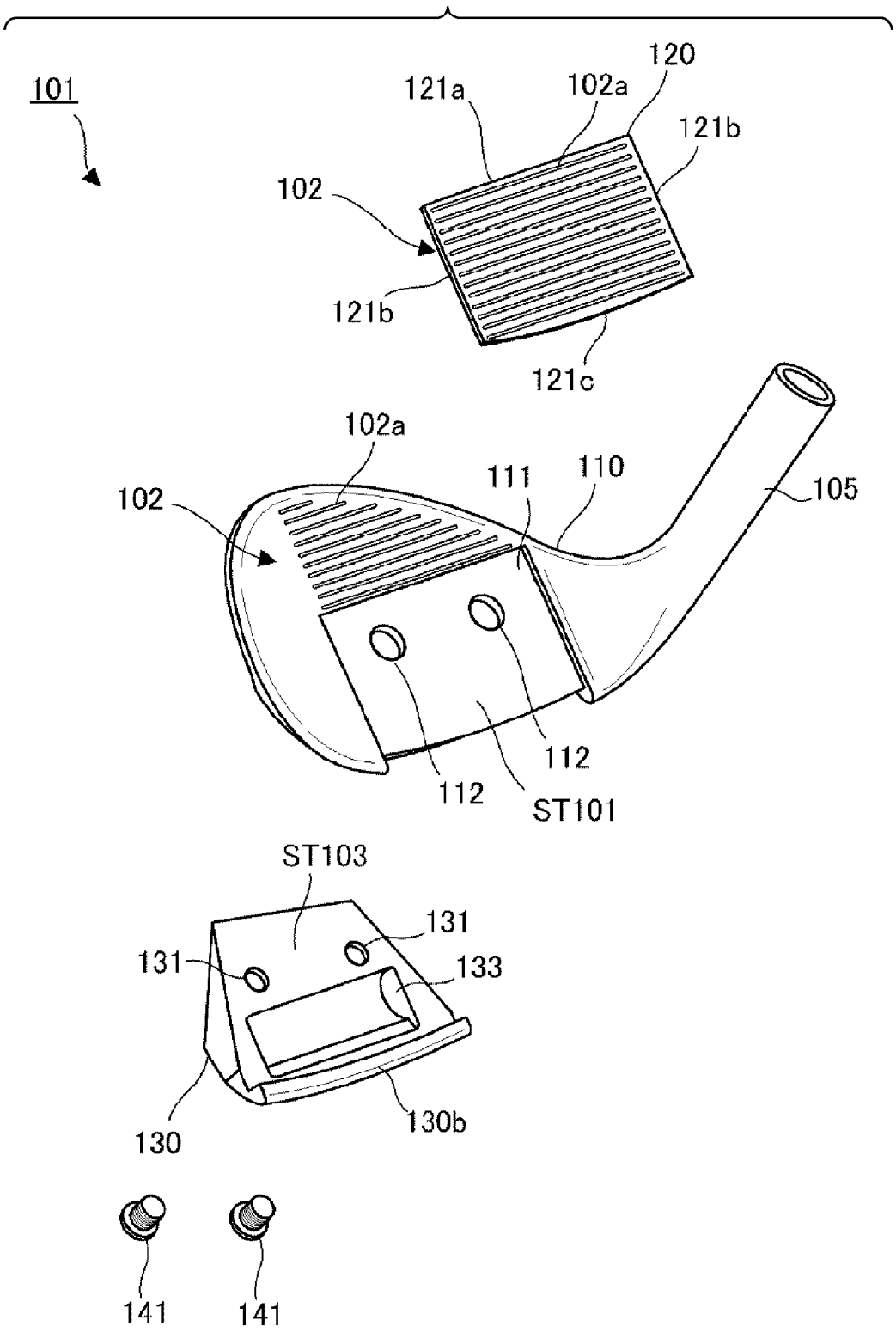
FIG. 5 is an exploded perspective view of the golf club head according to the second embodiment.
Figure 6:
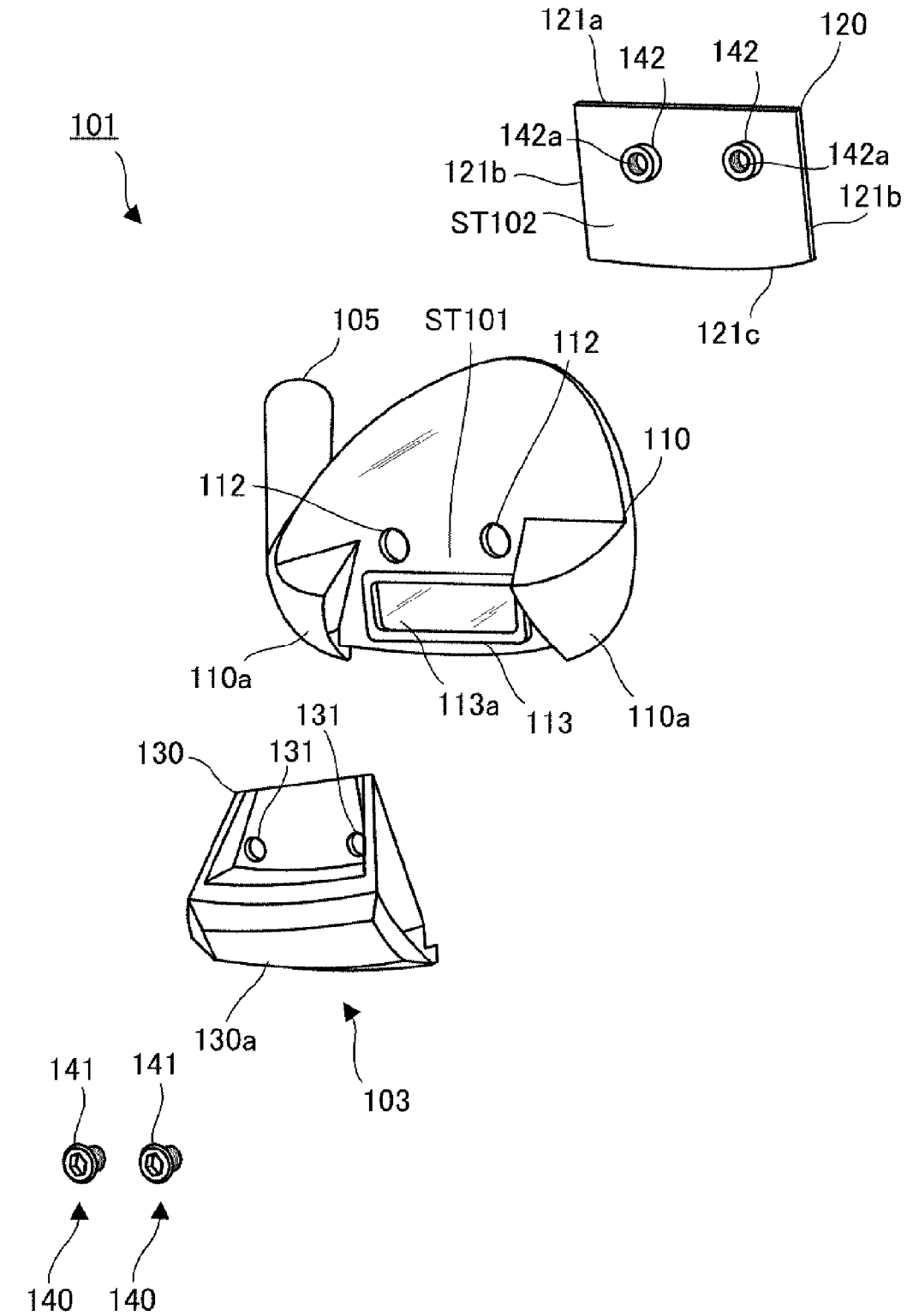
FIG. 6 is an exploded perspective view of the golf club head according to the second embodiment.

The golf club head 101 has an outer shape formed by the following three parts as its basic arrangement. That is, the golf club head 101 includes a main body member 110, face member 120, and sole member 130, which are fastened by two fastening structures 140 to be separable from each other. FIGS. 5 and 6 are exploded perspective views of the golf club head 101, in which FIG. 5 is an exploded perspective view when viewed from the side of the face surface; and FIG. 6 is an exploded perspective view when viewed from the back side.

The main body member 110 includes the hosel portion 105. The main body member 110 includes a recessed portion 111 which is formed on the side of the face surface 102 and in which the face member 120 is mounted. The recessed portion 111 has a notched lower portion.

Two holes 112 are formed in the recessed portion 111 to extend through the main body member 110 in the face-to-back direction. The two holes 112 are spaced apart from each other in the toe-to-heel direction. A rectangular cylinder-shaped projecting portion 113 is formed on the main body member 110 on the side of the back portion 104. The projecting portion 113 defines a recessed portion 113*a* formed in it. Sole portion forming portions 110*a* are formed on the two sides of the projecting portion 113.

The face member 120 serves to at least partially form the face surface 102. In this embodiment, the face member 120 partially forms the region of the face surface 102, in which the scorelines 102*a* are formed. More specifically, the face member 120 forms the lower portion of the scoreline forming region in the sole-to-top direction. In this embodiment, the face member 120 can be downsized because only a portion which is more likely to come into contact with a ball at the time of impact is formed by the face member 120. This is advantageous in terms of reducing the material cost.

The face member 120 has a quadrangular outer shape with an upper side 121*a*, a pair of lateral sides 121*b*, and a lower side 121*c*. The upper side 121*a* is a straight line parallel to the scorelines 102*a*. The pair of lateral sides 121*b* are straight lines perpendicular to the upper side 121*a*. The lower side 121*c* has an arcuated shape, but may be a straight line parallel to the scorelines 102*a*. In this embodiment, the face member 120 has a quadrangular shape, and therefore can be attached even to main body members 110 having face surfaces 102 with different shapes as long as the shape of the recessed portion 111 remains the same. In other words, various golf club heads can be fabricated by preparing pluralities of types of main body members 110 and face members 120 so that the user can select an appropriate combination of them.

The sole member 130 serves to at least partially form the sole portion 103. In this embodiment, the sole member 130 includes a portion 130*a* which forms the central portion of the sole portion 103 in the toe-to-heel direction. The portion 130*a* protrudes more than the sole portion forming portions 110*a* of the main body member 110, and practically solely functions as a sole portion. All of the plurality of types of sole members 130 are prepared so that portions 130*a* protrude more than sole portion forming portions 110*a*. When the bounce angle varies, the amount of protrusion of the portion 130*a* also varies with respect to the sole portion forming portions. However, by providing all sole members 130 so that portions 130*a* protrude more than sole portion forming portions 110*a*, a sense of discomfort in terms of design can be alleviated.

The sole member 130 also includes a portion 130*b* which forms the lower portion of the face surface 102. The portion 130*b* extends more to the top than the leading edge. In such an arrangement, among parting lines between the members 110 to 130, a parting line running in the toe-to-heel direction is absent in the sole portion 103. If a parting line running in the toe-to-heel direction is present in the sole portion 103, the golf club head 101 is easily clogged with, for example, sand. In this embodiment, a parting line running in the toe-to-heel direction is absent, in order to make it less likely for the golf club head 101 to become clogged with, for example, sand.

Two holes 131 are formed in the sole member 130 to extend through it in the face-to-back direction. The two holes 131 are spaced apart from each other in the toe-to-heel direction, like the holes 112. Also, a recessed portion 133 is formed in a portion of the sole member 130 on the side of the face surface 102. The recessed portion 133 has a contour with the same shape as that of the contour of the projecting portion 113 on the main body member 110, and the main body member 110 and sole member 130 are positioned by inserting the projecting portion 113 into the recessed portion 133. In other words, the projecting portion 113 and recessed portion 133 form a portion which positions the main body member 110 and sole member 130. The recessed portion 113*a* in the projecting portion 113, and the recessed portion 133 form a closed space, in which a weight distribution adjusting member, for example, can be accommodated, as in the above-mentioned first embodiment.

Each fastening structure 140 includes a bolt 141 and a screw hole 142*a* formed in the back surface of the face member 120. The screw hole 142*a* is formed by forming threads in the inner circumferential surface of a cylindrical boss portion 142 formed on the back surface of the face member 120.

In this embodiment, the main body member 110, face member 120, and sole member 130 include stack portions ST101, ST102, and ST103, respectively, stacked on each other in the face-to-back direction. The holes 112, screw holes 142*a*, and holes 131 are formed in the stack portions ST101, ST102, and ST103, respectively. The face member 120, main body member 110, and sole member 130 are stacked on each other in the face-to-back direction to align the screw holes 142*a* and holes 112 and 131. At this time, the stack portion ST101 is positioned between the stack portions ST102 and ST103. In this embodiment, the boss portions 142 are inserted into the holes 112 so as to easily align the main body member 110 and face member 120.

Each bolt 141 is inserted into the holes 131 and 112 so as to thread into the screw hole 142*a*, thereby fastening it. Upon this operation, the main body member 110, face member 120, and sole member 130 are fastened together and fixed to each other in the stack portions ST101 to ST103.

Since the main body member 110, face member 120, and sole member 130 are fastened together and fixed to each other, they can be simultaneously disassembled and fixed to each other simply by inserting/removing the bolts 141. This makes it easy to disassemble and assemble the golf club head 101. Also, preparing pluralities of types of face members 120 and sole members 130 allows the user to replace the parts in accordance with his or her tastes.

Note that in this embodiment as well, various modifications (for example, the use of a buffer member and a weight distribution adjusting member, and the arrangement of a fastening structure) described in the above-mentioned first embodiment can be adopted as needed.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2011-236440, filed Oct. 27, 2011, which is hereby incorporated by reference herein in its entirety.

What is claimed is:

1. A golf club head including a face surface and a sole portion, comprising:

a main body member;

a face member which at least partially forms the face surface;

a sole member which at least partially forms the sole portion; and a fastening structure which fastens said main body member, said face member, and said sole member to be separable from each other, wherein said main body member, said face member, and said sole member include stack portions, respectively, which are stacked on each other, wherein said stack portion of said main body member is positioned between said stack portion of said face member and said stack portion of said sole member, wherein said face member includes a boss portion which is formed in said stack portion of said face member and protrudes from a back surface of said face member, wherein said main body member includes a hole into which said boss portion is inserted, wherein said sole member includes a hole formed in said stack portion of said sole member, wherein said main body member includes a projecting portion, wherein said sole member includes a recessed portion into which said projecting portion is inserted, and wherein said fastening structure comprises a screw hole formed in said boss portion, and a bolt which threadably engages with said screw hole through said hole of said sole member and said hole of said main body so as to fasten said main body member, said face member, and said sole member together in said stack portions.

2. The head according to claim 1, wherein said head includes a plurality of said fastening structures.

3. The head according to claim 1, wherein said sole member is made of a material harder than a material of said main body member.

4. The head according to claim 1, wherein a difference between a specific gravity of a material of said main body member and a specific gravity of a material of said sole member is not less than 1.

5. The head according to claim 1, wherein said sole member includes a lower portion of the face surface.

6. The head according to claim 1, wherein a buffer member is interposed between said main body member, said face member, and said sole member that are adjacent to each other.

7. The head according to claim 1, wherein said face member is made of a material softer than a material of said main body member.

8. The head according to claim 1, wherein said face member has a quadrangular outer shape including an upper side parallel to a scoreline formed in the face surface, a pair of lateral sides perpendicular to said upper side, and a lower side having one of a linear shape and an arcuated shape.

9. The head according to claim 1, wherein said sole member includes recessed portions which form closed spaces with a black surface of said main body member, and said closed spaces are adapted to contain weight distribution adjusting members.

* * * * *